US005611121A

United States Patent [19]

Akeno et al.

[11] Patent Number: 5,611,121

[45] Date of Patent: Mar. 18, 1997

[54] AUTOMATIC LOCK SLIDER FOR CONCEALED SLIDE FASTENER

[75] Inventors: Mitsuru Akeno; Nobuhiro Ichikawa, both of Toyama-ken, Japan

[73] Assignee: YKK Corporation, Tokyo, Japan

[21] Appl. No.: 650,601

[22] Filed: May 20, 1996

[30] Foreign Application Priority Data

May 19, 1995 [JP] Japan ..... 7-121455

[51] Int. Cl.[6] ..... A44B 19/00

[52] U.S. Cl. ..... 24/423; 24/419; 24/425; 24/429

[58] Field of Search ..... 24/423, 421, 425, 24/429, 430, 431, 432, 419, 417, 418, 420

[56] References Cited

U.S. PATENT DOCUMENTS 2,790,224 4/1957 Mercer ..... 24/429

4,829,638 5/1989 Ishii ..... 24/421

5,175,910 1/1993 Mizuno ..... 24/421

FOREIGN PATENT DOCUMENTS 7416344 6/1975 Netherlands ..... 24/423

*Primary Examiner*—Victor N. Sakran

*Attorney, Agent, or Firm*—Hill, Steadman & Simpson

[57] ABSTRACT

In an automatic lock slider for a concealed slide fastener, a fastener-element guide post of a slider body has an upper groove receiving a locking lever and a lower groove slidably receiving a sliding end of a pivoting release member. A spring mounted in the guide post acts on an actuating arm of the locking lever to urge a locking pawl of the locking lever to normally project into a fastener-element guide channel of the slider body. An ornamental knob attached to the pivoting release member covers exposed part of the slider body. As the knob is pulled to pivotally move the release member, the locking pawl is retracted from the guide channel.

18 Claims, 4 Drawing Sheets

AUTOMATIC LOCK SLIDER FOR CONCEALED SLIDE FASTENER

BACKGROUND OF THE INVENTION

1. Field of the Invention

This invention relates to a concealed slide fastener in which a pair of fastener element rows is covered up by a pair of fastener tapes on the side exposed to the outside, and more particularly to an automatic lock slider, for such a concealed slide fastener, in which an ornament such as a jewel is attached to a slider body as a knob, instead of a hanging pull tab, for covering the majority part of the slider body.

2. Description of the Related Art

It is currently known to adorn a garment by attaching an ornament to a slider of a slide fastener used on the garment. This conventional art is exemplified by: Japanese Utility Model Laid-Open Publication No. Sho 48-41403, in which a ring is pivotally connected to a pull-tab lug projecting from the upper wing of a slider body, and a tray larger than the slider body and carrying an ornament as a knob is attached to the ring so as to conceal the slider body on the upper side, i.e. the exposed side; Japanese Utility Model Laid-Open Publication No. Sho 62-5007, in which front and rear lugs, the front lug being a snap type, are formed on the upper wing of a slider body, and an ornament larger than the slider body is attached to the lugs in a snap action as a knob, concealing the slider body on the exposed side; Japanese Utility Model Publication No. Hei 1-141612, in which an ornament substantially equal in size to a slider body is fixed to the upper wing of the slider body as a knob; and a Japanese Utility Model Publication No. Hei 2-12888, in which a slider body has a T-shape lug on its upper wing, and an ornament having a T-shape hole is threaded on the T-shape lug as a knob, whereupon the T-shape lug is twisted by 90° to prevent any further rotation of the ornament.

According to any of the foregoing conventional type of a slide fastener in which the slider body is covered up by the ornament, a pair of fastener element rows is exposed to the outside, thus making the attached garment not fashionable. Further, in this conventional type slider, since an ornament can be attached to only the upper wing of the slider body, attaching means for the ornament is merely fixed to the upper wing or pivotally attached to the pull tab lug on the upper wing, both of which could not be adopted in an automatic lock slider.

SUMMARY OF THE INVENTION

It is therefore an object of this invention to provide an automatic lock slider for a concealed slide fastener, in which a slide fastener having a pair of fastener element rows completely concealed by opposed fastener tapes has a slider attached with an ornamental knob so as that the slider as well as the fastener elements are completely covered up on the exposed side, thus achieving a reliable ornamental function, and in which the ornamental slider is combined with an automatic lock mechanism without any risk of deteriorating the automatic locking feature.

In order to accomplish the above object, according to this invention, there is provided an automatic lock slider for a concealed slide fastener, comprising: a slider body having a fastener-element guide post and a fastener-element guide channel; a locking lever pivotally mounted on the guide post and having at one end a locking pawl; a spring mounted in the guide post and urging the locking pawl of the locking lever so as to normally project into the guide channel; a pivoting release member pivotally mounted on the guide post and operatively connected with the locking lever, the pivoting release member being pivotally movable between a locking position in which the locking pawl projects into the guide channel and a release position in which the locking pawl is retracted from the guide channel; and a knob attached to an upper surface of the pivoting release member for pulling the pivoting release member, in an opening direction of the slide fastener, from the locking position to the release position against the resilience of the spring.

Preferably, the locking lever has at one end the locking pawl and at the other end an actuating arm having in its base a circular hole, the pivoting release member including a support plate and a generally C-shape supporting portion integrally formed on a lower surface of the support plate, the supporting portion having in its corner a slot, the pivoting release member and the locking lever being pivotally mounted on the guide post, with the locking lever pivotally received in the supporting portion, by a common pivot extending through the circular hole and the slot in such a manner that the pivoting release member is slidable on an upper surface of the guide post while the locking lever is turnable about the pivot, the spring in the guide post urging the actuating arm of the locking lever against a cam surface of the supporting portion.

Further, the guide post has in its upper part an upwardly opening U-shape groove and in its lower part a forwardly and downwardly opening groove, the pivoting release member having at the base of the supporting portion a pair of parallel holding plates between which the locking lever is slidably received, the supporting portion having a sliding end of a square cross section slidably received in the groove, the holding plates being slidably received in the U-shape groove.

Alternatively, the locking lever has at one end a recess upwardly of the locking pawl and at the other end an actuating projection, the locking lever having in a base of the actuating projection a circular hole and mounted in the guide post, the pivoting release member having a support plate which is situated upwardly of the locking lever and has at one end a pivoting projection and at the other end a U-shape catch to be engaged in the recess of the locking lever, the pivoting projection of the pivoting release member being pivotally attached to the guide post via a circular hole, the spring urging actuating projection of the locking lever in such a manner that the locking lever is pivotally moved to normally bring the locking pawl into the guide channel.

Further, the guide post has at its upper part an upwardly opening U-shape groove and front and rear pivot holes forwardly and rearwardly of the U-shape groove, the locking lever being pivotally attached to the guide post by a pivot extending through the circular hole and the rear pivot hole, the pivoting release member being pivotally attached to the guide post by a pivot extending through the circular pivot hole and the front pivot hole, the pivoting release member lying over the locking lever.

In the slider of this invention, the knob is an ornament fixed to the pivoting release member so as to cover exposed part of the slider body. Further, the knob has a socket tube projecting from its lower surface, and the pivoting release member has a plug to be inserted in the socket tube, the socket tube and/or the plug having means for preventing their mutual rotation and detachment.

In operation, as the pivoting release member pivotally mounted on the fastener-element guide post of the slider body is pivotally moved, the locking pawl of the locking lever pivotally mounted on the fastener-element guide post projects into and retracts from the fastener-element guide channel to come into and out of engagement with the fastener element rows.

In the slider of a first embodiment of this invention, if the knob is pulled forwardly and backwardly to pivotally move the pivoting release member, the locking lever is pivotally moved to bring its locking pawl into and out of the fastener-element guide channel. If the pivoting release member is slid backwardly of the slider body, i.e. in an opening direction of the fastener, the cam surface of the supporting portion of the pivoting release member pushes the sloping surface of the locking lever against the resilience of the spring to raise the locking pawl off the guide channel so that the locking pawl releases the fastener element rows, thus allowing the slider to be freely slid backwardly to open the fastener chain.

When the knob is released off the pull, the locking lever pushes the pivoting release member outwardly under the resilience of the spring, and as a result, the locking pawl projects into the guide channel to engage the fastener element rows, thus automatically locking the slider to stop. If the knob is pulled to slide the slider forwardly, i.e. in a closing direction of the fastener, the locking pawl is automatically sprung out by the fastener element rows against the resilience of the spring so that the slider can be moved freely. The fastener chain is closed by thus moving the slider; if the slider is stopped at a desired position on the fastener element rows, it cannot make a further movement until it is positively slid by pulling the knob.

In the slider of a second embodiment of this invention, unlike the previous slider, if the knob is pulled to pivotally move the pivoting release member forwardly, the catch of the pivoting release member raise the locking pawl against the resilience of the spring so that the slider can be freely slid forwardly or backwardly to open or close the fastener chain. If the knob is released off the pull to stop the slider after sliding, the locking pawl projects in the guide channel to engage the fastener element rows as the locking lever is pivotally moved under the resilience of the spring acting on the activating projection of the locking lever so that the slider is automatically locked and hence cannot be freely slid. To release the locking of the slider, the pivoting release member is positively pivotally moved in the above-mentioned manner to raise the locking pawl off the guide channel.

DETAILED DESCRIPTION OF THE PREFERRED EMBODIMENTS

Preferred embodiments of this invention will now be described in detail with reference to the accompanying drawings.

Figure 1:
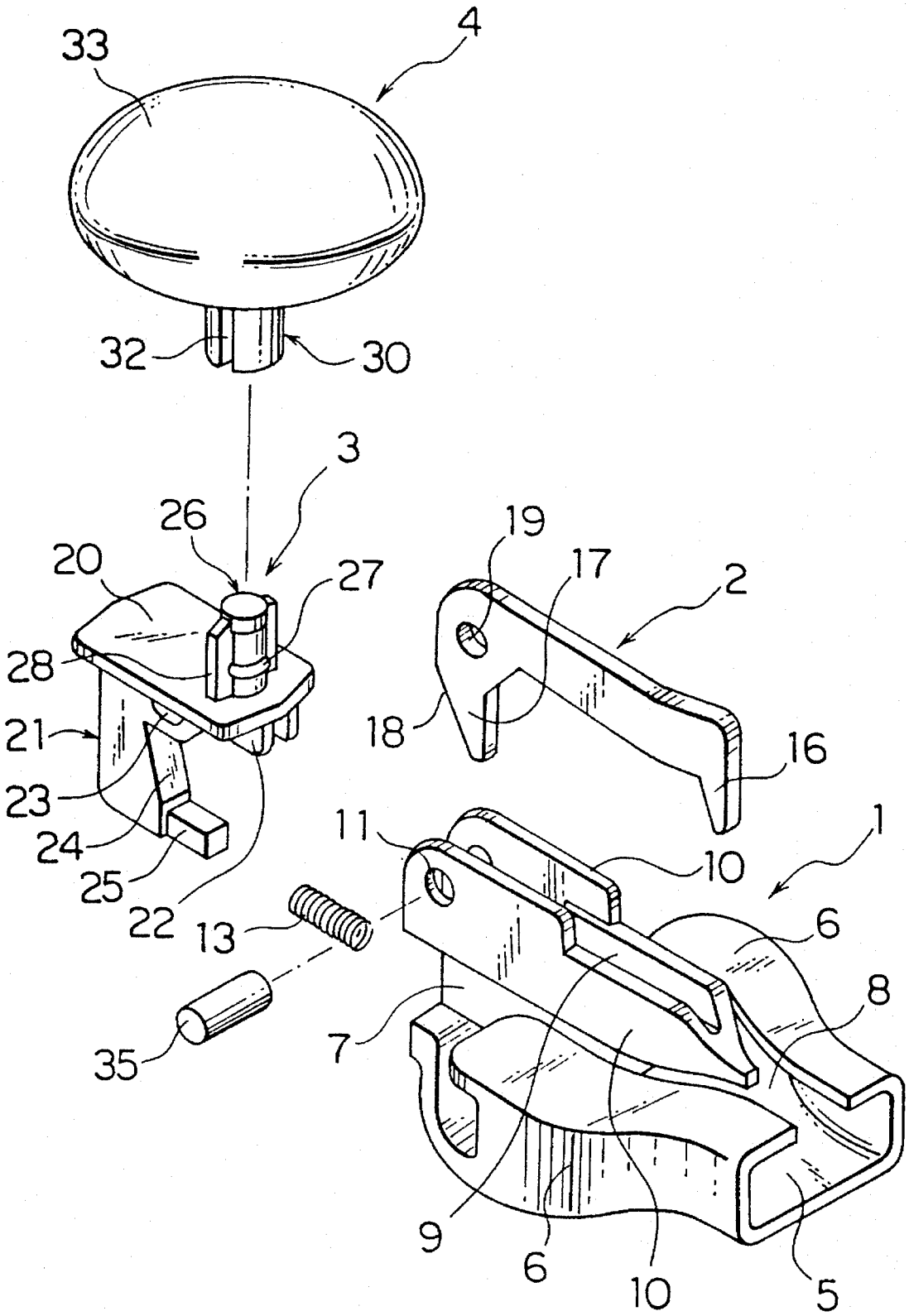
FIG. 1 is an exploded perspective view of an automatic lock slider, for a concealed slide fastener, according to a first embodiment of this invention.
Figure 2:
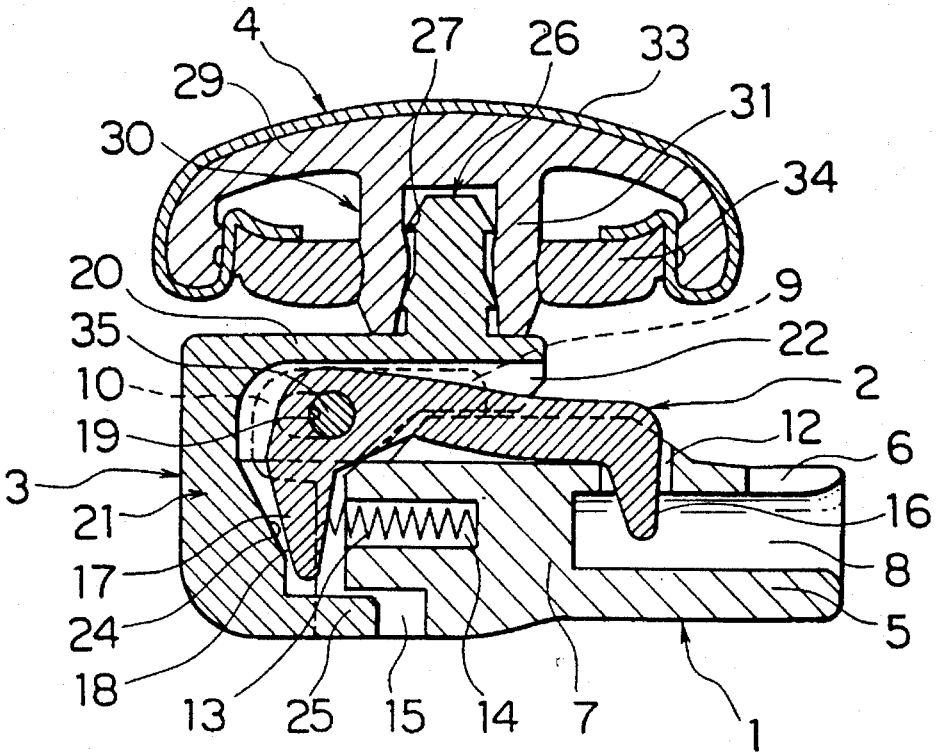
FIG. 2 is a longitudinal cross-sectional view of the slider of FIG. 1, showing the slider in a locked posture.
Figure 3:
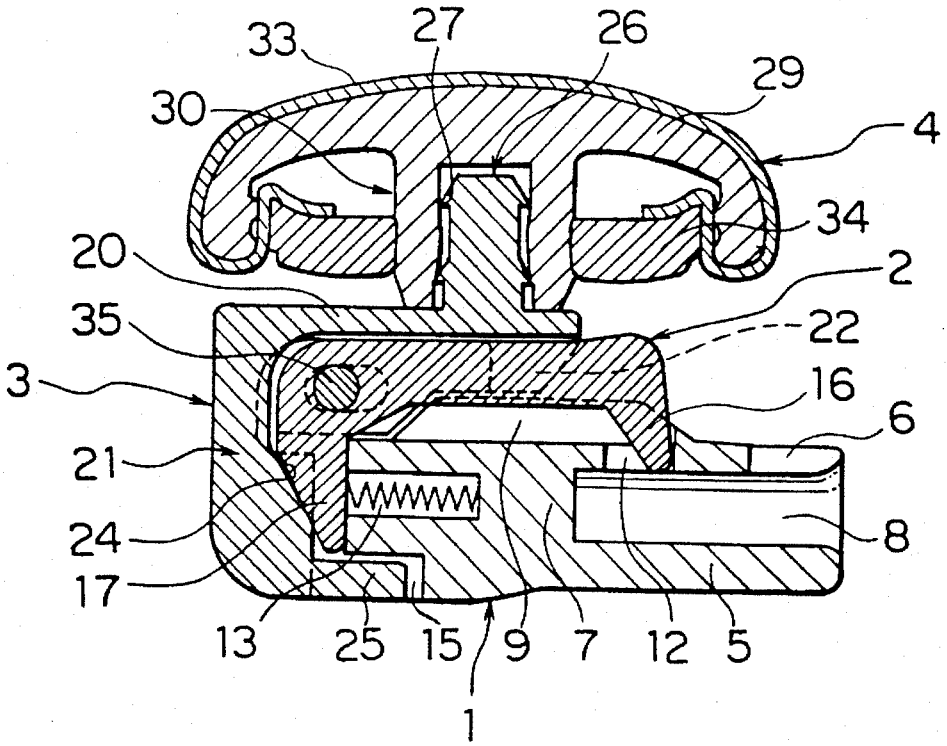
FIG. 3 is a longitudinal cross-sectional view similar to FIG. 2, but showing the slider in a released posture.

FIGS. 1 through 3 show an automatic lock slider, for a concealed slide fastener, according to a first embodiment of this invention. As shown in FIGS. 1 through 3, the slider comprises a slider body 1, a locking lever 2, a pivoting release member 3 and a knob 4; the slider body 1 has a bottom plate 5, a pair of fastener-element guide flanges 6 projecting from opposite side edges of the bottom plate 5, and a fastener-element guide post 7 standing from the bottom plate 5 at a position toward its front end, defining a fastener-element guide channel 8. The guide post 7 bas in its upper part a receiving portion 9 in a shape of an upwardly opening U-shape groove extending toward the rear end of the slider body 1. Opposite side walls 10 of a the U-shape groove 9 have a pair of laterally aligned pivot holes 11 at a position toward the front end, and a bottom of the U-shape groove 9 has at a position toward its rear end an aperture 12. The guide post 7 has in its front end a horizontal blind hole 14 in which an compression spring 13 is to be received, and in its lower part a longitudinal groove 15.

The locking lever 2 is made from a sheet of metal and has at one end a triangular tongue-like locking pawl 16 bent downwardly and at the other end a tongue-like actuating arm 17 bent likewise the locking pawl 16. The actuating arm 17 has on its outer side a sloping surface 18 and in its inner base a circular hole 19.

The pivoting release member 3 has a flat support plate 20 with a C-shape supporting portion 21 formed integrally with the lower surface of the support plate 20, and a pair of parallel holding plates 22 at a base of the supporting portion 21 toward the support plate 20, inbetween which the locking lever 2 is to be fitted. The supporting portion 21 has at its corner a slot 23 parallel to the support plate 20. The supporting portion 21 has a sloping cam surface 24 on its inner wall and a square-rod-like sliding end 25 to be slidably received in the groove 15 of the guide post 7. Also the support plate 20 has a plug 26 projecting from its upper surface at a position toward its rear side end, the plug 26 having on its peripheral surface a number of serrated ledges 27 and a pair of fins 28 projecting in opposite directions.

The knob 4 has a socket tube 30 projecting centrally from the lower surface of an umbrella-shaped base plate 29, the socket tube 30 having at its central part a curved portion 31 slighting inwardly bulging and in its lower part a pair of split grooves 32 in which the opposite fins 28 of the plug 26 are to be fitted. The upper surface of the base plate 29 is covered by an ornament 33, and a donut-shape bottom plate 34 is threaded on the tube 30 to seal the peripheral edge of the base plate 29 and the curved portion 31 of the tube 30, holding the peripheral edge of the ornament 33 between the peripheral edge of the base plate 29 and the outer peripheral edge of the bottom plate 34. The ornament should by no means be limited to the illustrated example and may be a jewel or an imitation directly attached to the base plate having a tube, so as to be a knob.

For assembling the slider, the spring 13 is inserted into the blind hole 14 of the guide post 7 of the slider body 1, and the locking lever 2 is placed in the guide post 7 in such a manner that the outer end of the spring 13 is in contact with the actuating arm 17 of the locking lever 2, and is then covered from the outside by the pivoting release member 3. At that time, the locking lever 2 is received between the holding plates 22 of the pivoting release member 3 and then received in the U-shape groove 9 of the guide post 7, and the sliding end 25 of the supporting portion 21 is inserted into the lower groove 15 at the lower surface of the guide post 7, and a pivot 35 is inserted through the pivot holes 11 of the U-shape groove 9, the slot 23 of the supporting portion 21 and the circular hole 19 of the locking lever 2 after these slot and holes are laterally aligned. When the tube 30 of the knob 4 is threaded on the plug 26 of the support plate 20, at which time the opposite fins 28 are inserted into the split grooves 32 until the peripheral ledges 27 of the plug 26 are brought into tight contact with the curved portion 31 of the tube 30 to prevent the knob 4 from removal. As a result, the knob 4 is fixedly attached to the pivoting release member 3 in such a posture as to cover the exposed part of the slider body 1, thus completing the assembling of the automatic lock slider for a concealed slide fastener.

Figure 4:
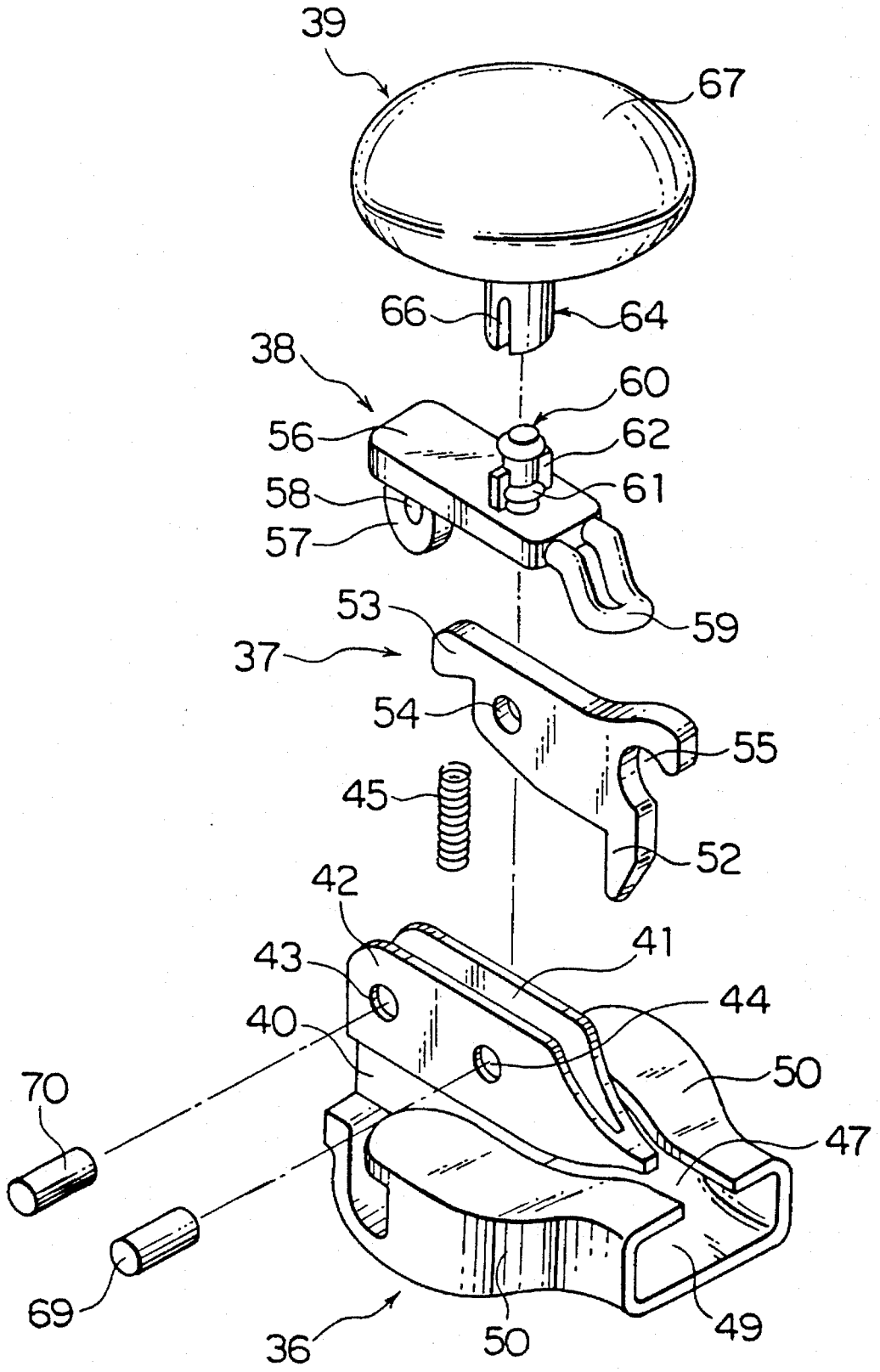
FIG. 4 is an exploded perspective view of an automatic lock slider according to a second embodiment of the invention.
Figure 5:
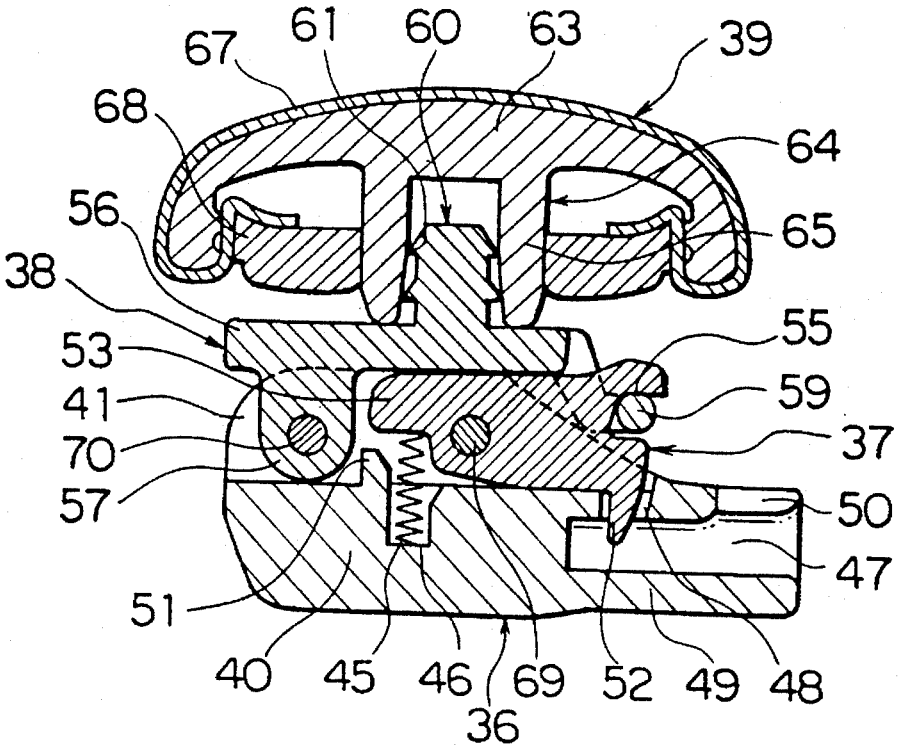
FIG. 5 is a longitudinal cross-sectional view of the slider of FIG. 4, showing the slider in a locked posture.
Figure 6:
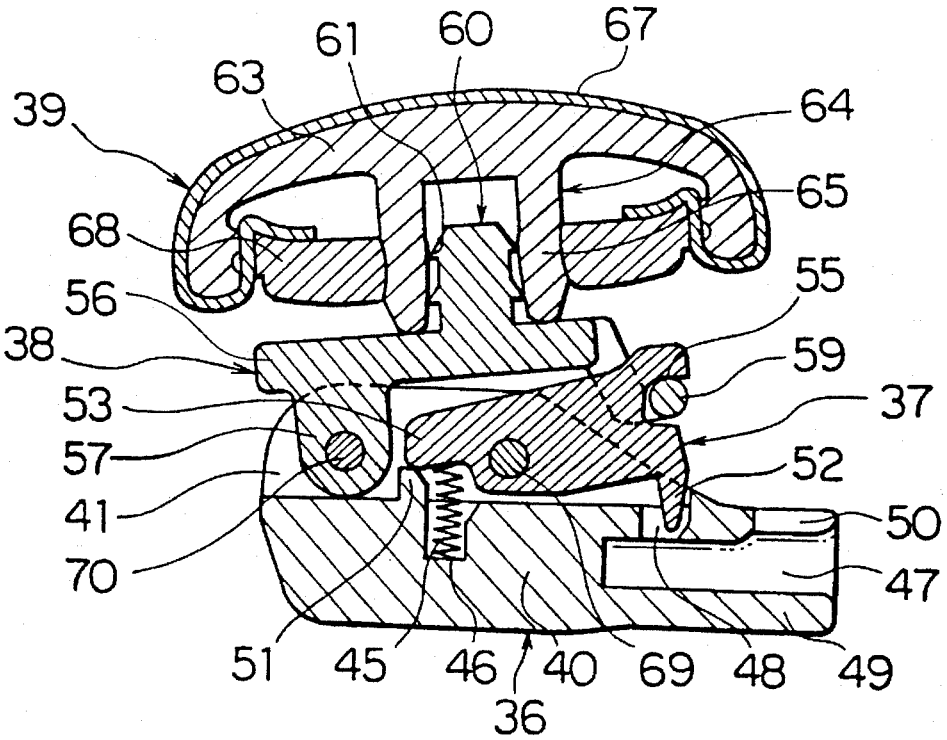
FIG. 6 is a longitudinal cross-sectional view similar to FIG. 5, but showing the slider in a released posture.

FIGS. 4 through 6 show a modified automatic lock slider, for a concealed slide fastener, according to a second embodiment. The modified slider, like the foregoing slider, is a four-member structure comprising a slider body 36, a locking lever 37, a pivoting release member 38 and a knob 39. A fastener-element guide post 40 of the slider body 36 has at its upper part an upwardly opening U-shape groove 41, opposite side walls 42 of which have a pair of laterally aligned front pivot holes 43 and a pair of laterally aligned rear holes 44, and in the bottom of which a vertical blind hole 46 is formed at a position between the front and rear holes 43, 44 for receiving a spring 45. Also the bottom of the U-shape groove 41 has in its rear extension an aperture 48 communicating with a fastener-element guide channel 47. In FIGS. 4 through 6, reference numeral 49 designates a bottom plate; 50, opposite fastener-element guide flanges; and 51, a stop projecting from the edge of the blind hole 46 for restricting pivotal movement of the locking lever 37.

The locking lever 37 has at one end a triangular tongue-shape locking pawl 52 bent downwardly and at the other end a tongue-shape actuating arm horizontally projecting 53. Also the locking lever 37 has in its base a circular hole 54 and in a position upward and outward of the locking pawl 52 a recess 55 with which the pivoting release member 38 is to be brought into engagement.

The pivoting release member 38 has a flat support plate 56, a pivoting projection 57 extending downwardly from one end of the support plate 56 and having the same thickness as that of the locking lever 37, and a U-shape catch 59 projecting outwardly from the other end of the support plate 56, the pivoting projection 57 having a circular hole 58. A free end of the catch 59 is slightly downwardly bent so as to be smoothly engaged the recess 55 of the locking lever 37. The support plate 56 has a plug 60 on its upper surface at a position toward the rear end, from which the catch 59 projects, and the plug 60 has on its peripheral surface a number of serrated ledges 61 and a pair of fins 62 projecting in opposite directions.

The knob 39 has a socket tube 64 projecting centrally from the lower surface of an umbrella-shape base plate 63 and having at its central part a slighting inwardly bulging curved portion 65 and in its lower end part a pair of opposite split grooves 66 in which the opposite fins 62 of the plug 60 are to be fitted. The upper surface of the base plate 63 is covered by an ornament 67, and a donut-shape bottom plate 68 is threaded on the tube 64 to seal the peripheral edge of the base plate 63 and the curved portion 65 of the tube 64, holding the peripheral edge of the ornament 67 between the peripheral edge of the base plate 63 and the outer peripheral edge of the bottom plate 68.

For assembling the slider, the locking lever 37 and the pivoting release member 38 are pivotally mounted in the U-shape groove 41 of the guide post 40 of the slider body 36. At that time, firstly the spring 46 is received in the vertical bind hole 46 in the U-shape groove 41 so as to act on the actuating projection 53 of the locking lever 37, and a pivot 69 is threaded through the rear pivot holes 44 of opposite side walls of the U-shape groove 41 and the circular hole 54 of the locking lever 37, after these holes 44, 54 are laterally aligned, with the locking pawl 52 inserted through the aperture 48. Then the catch 59 of the support plate 56 of the pivoting release member body 38 is engaged in the recess 55 of the locking lever 37, whereupon a pivot 70 is threaded through the circular hole 58 of the pivoting projection 57 and the front pivot holes 43 of the U-shape groove 41 after these holes 43, 58 are laterally aligned. In the meantime, when the tube 64 of the knob 39 is threaded on the plug 60 on the support plate 56 of the pivoting release member 38, the opposite fins 62 of the plug 60 are inserted through the opposite split grooves 66 of the tube 64 until the peripheral ledges 61 of the plug 60 are brought into tight contact with the curved portion 65 of the tube 64 to prevent the knob 39 from removal. As a result, the knob 39 is fixedly attached to the pivoting release member 38 in such a posture as to cover the exposed part of the slider body 36, thus completing the assembly of the automatic lock slider for a concealed slide fastener.

The automatic lock slider, for a concealed slide fastener, having a structure described in the foregoing disclosure has the following advantageous results:

With the slider structure of the first embodiment in which the locking lever 2, with the locking pawl 16 retractably projecting into the guide channel 8 of the slider body 1, is pivotally mounted on the guide post 7 and is urged by the spring 13 so as to normally bring the locking pawl 16 into the guide channel 8 and in which the locking pawl 16 is retractable from the guide channel 8 by the action of the pivoting release member 3 pivotally mounted on the guide post 7 and in which the ornamental knob 4 is attached to the upper surface of the pivoting release member 3, it is possible to realize an auto-lock concealed slide fastener in which a pair of fastener element rows is completely concealed by opposed fastener tapes and in which the slider can be completely concealed by the ornamental knob 4 on the exposed side of the slide fastener in a simple way, which could not conventionally be realized. Since the fastener chains and the slider are completely concealed, a reliable ornamental function is guaranteed, without any risk of deteriorating the automatic locking feature.

Further, with the first-named slider structure in which the actuating arm 17 of the locking lever 2 has a circular hole 19 in its base while the C-shape supporting portion 21 extending from the lower surface of the support plate 20 of the pivoting release member 3 has at its corner a slot 23 and in which the locking lever 2 and the pivoting release member 3 are pivotally mounted on the guide post 7 by a common pivot 35 extending through the circular hole 19 of the locking lever 2 and the slot 23 of the pivoting release member, so that the locking lever 2 is pivotally movable on the slider body 1 while the pivoting release member 3 is slidable on the slider body 1, with the spring 13 urging the actuating arm 17 of the locking lever 2 against the cam surface 24 of the supporting portion 21, and in which the ornamental knob 4 is attached to the upper surface of the pivoting release member 3, it is possible to realize an automatic lock slider in which an excellent operativity and adequate locking feature can be achieved by a simple actuating mechanism.

Further, partly since the locking lever 2 is received in the upwardly opening U-shape groove 9 of the guide post 7 and between the parallel holding plates 22 at the base of the supporting portion 21 of the pivoting release member 3, and partly since the sliding end 25 of the supporting portion 21 is slidably received in the groove 15 at the lower surface of the guide post 7, the locking lever 2 can make a reliable locking action without any damage while the pivoting release member 3 can be slid stably.

With the second-named slider structure in which the locking lever 37 having at one end upward of the locking pawl 52 a recess 55 and at the opposite end a horizontal actuating projection 53 is pivotally mounted on the inner side of the guide post 42 while the pivoting release member 38 having at one end of the support plate 56 a pivoting projection 57 and at the other end thereof a catch 59 engaged in the recess 55 is pivotally mounted on the front side of the guide post 40, with the spring 45 urging the actuating projection 53 of the locking lever 37 so as to normally bring the locking pawl 52 into the guide channel 47, and in which the ornamental knob 39 is attached to the upper surface of the pivoting release member 38, it is possible to realize an auto-lock concealed slide fastener in which as both the pivoting release member 38 and the locking lever 37 are pivotally moved, the stroke of the pivoting release member 38 is small while the stroke of the locking lever 37 is large, so that the locking lever 37 can make the locking and releasing feature reliably and stably.

Further, partly since the locking lever 37 and the pivoting release member 38 are received in series in the upwardly U-shape groove 41 of the guide post 40 and are pivotally attached to the guide post 40 by the respective pivots 69, 70, and partly since the locking lever 37 is covered by the pivoting release member 38, both the pivoting release member 38 and the locking lever 37 can make their respective actions smoothly as the locking lever 37 is safely protected by the locking release member 38.

In addition, partly since a pair of fastener element rows are completely concealed by opposed fastener tapes, and partly since the knob 4, 39 of the slider is an ornament and fixedly attached to the pivoting release member 3, 38 so as to cover the front part of the slider body 1, 36, an improved ornamental feature can be quaranteed. Further, the knob 4, 39 has the socket tube 30, 64 while the pivoting release member 3, 38 has the plug 26, 60 to be fitted in the tube 30, 64, it is possible to facilitate attaching the knob 4, 39 to the pivoting release member 4, 39 firmly with maximum ease.

What is claimed is:

1. An automatic lock slider for a concealed slide fastener, comprising:

(a) a slider body having a fastener-element guide post anti a fastener-element guide channel;

(b) a locking lever pivotally mounted on said guide post and having at one end a locking pawl;

(c) a spring mounted in said guide post and urging said locking pawl of said locking lever so as to normally project into said guide channel;

(d) a pivoting release member pivotally mounted on said guide post and operatively connected with said locking lever, said pivoting release member being pivotally movable between a locking position in which said locking pawl projects into said guide channel and a release position in which said locking pawl is retracted from said guide channel; and (e) a knob attached to an upper surface of said pivoting release member for pulling said pivoting release member, in an opening direction of the slide fastener, from said locking position to said release position against the resilience of said spring.

2. An automatic lock slider for a concealed slide fastener according to claim 1, wherein said locking lever has at one end said locking pawl and at the other end an actuating arm having in its base a circular hole, said pivoting release member including a support plate and a generally C-shape supporting portion integrally formed on a lower surface of said support plate, said supporting portion having in its corner a slot, said pivoting release member and said locking lever being pivotally mounted on said guide post with said locking lever pivotally received in said supporting portion, by a common pivot extending through said circular hole and said slot in such a manner that said pivoting release member is slidable on an upper surface of said guide post while said locking lever is turnable about said pivot, said spring in said guide post urging said actuating arm of said locking lever against a cam surface of said supporting portion.

3. An automatic lock slider for a concealed slide fastener according to claim 2, wherein said guide post has in its upper part an upwardly opening U-shape groove and in its lower part a forwardly and downwardly opening groove, said pivoting release member having at the base of said supporting portion a pair of parallel holding plates between which said locking lever is slidably received, said supporting portion having a sliding end of a square cross section slidably received in said groove, said holding plates being slidably received in said U-shape groove.

4. An automatic lock slider for a concealed slide fastener according to claim 2, wherein said knob is an ornament fixed to said pivoting release member so as to cover exposed part of said slider body.

5. An automatic lock slider for a concealed slide fastener according to claim 2, wherein said knob has a socket tube projecting from its lower surface, and said pivoting release member has a plug to be inserted in said socket tube, said socket tube and/or said plug having means for preventing their mutual rotation and detachment.

6. An automatic lock slider for a concealed slide fastener according to claim 1, wherein said guide post has in its upper part an upwardly opening U-shape groove and in its lower part a forwardly and downwardly opening groove, said pivoting release member having at the base of said supporting portion a pair of parallel holding plates between which said locking lever is slidably received, said supporting portion having a sliding end of a square cross section slidably received in said groove, said holding plates being slidably received in said U-shape groove.

7. An automatic lock slider for a concealed slide fastener according to claim 6, wherein said knob is an ornament fixed to said pivoting release member so as to cover exposed part of said slider body.

8. An automatic lock slider for a concealed slide fastener according to claim 6, wherein said knob has a socket tube projecting from its lower surface, and said pivoting release member has a plug to be inserted in said socket tube, said socket tube and/or said plug having means for preventing their mutual rotation and detachment.

9. An automatic lock slider for a concealed slide fastener according to claim 1, wherein said locking lever has at one end a recess upwardly of said locking pawl and at the other end an actuating projection, said locking lever having in a base of said actuating projection a circular hole and mounted in said guide post, said pivoting release member having a support plate which is situated upwardly of said locking lever and has at one end a pivoting projection and at the other end a U-shape catch to be engaged in said recess of said locking lever, said pivoting projection of said pivoting release member being pivotally attached to said guide post via a circular hole, said spring urging actuating projection of said locking lever in such a manner that said locking lever is pivotally moved to normally bring said locking pawl into said guide channel.

10. An automatic lock slider for a concealed slide fastener according to claim 9, wherein said guide post has at its upper part an upwardly opening U-shape groove and front and rear pivot holes forwardly and rearwardly of said U-shape groove, said locking lever being pivotally attached to said guide post by a pivot extending through said circular hole and said rear pivot hole, said pivoting release member being pivotally attached to said guide post by a pivot extending through said circular pivot hole and said front pivot hole, said pivoting release member lying over said locking lever.

11. An automatic lock slider for a concealed slide fastener according to claim 9, wherein said knob is an ornament fixed to said pivoting release member so as to cover exposed part of said slider body.

12. An automatic lock slider for a concealed slide fastener according to claim 9, wherein said knob has a socket tube projecting from its lower surface, and said pivoting release member has a plug to be inserted in said socket tube, said socket tube and/or said plug having means for preventing their mutual rotation and detachment.

13. An automatic lock slider for a concealed slide fastener according to claim 1, wherein said guide post has at its upper part an upwardly opening U-shape groove and front and rear pivot holes forwardly and rearwardly of said U-shape groove, said locking lever being pivotally attached to said guide post by a pivot extending through said circular hole and said rear pivot hole, said pivoting release member being pivotally attached to said guide post by a pivot extending through said circular pivot hole and said front pivot hole, said pivoting release member lying over said locking lever.

14. An automatic lock slider for a concealed slide fastener according to claim 13, wherein said knob is an ornament fixed to said pivoting release member so as to cover exposed part of said slider body.

15. An automatic lock slider for a concealed slide fastener according to claim 13, wherein said knob has a socket tube projecting from its lower surface, and said pivoting release member has a plug to be inserted in said socket tube, said socket tube and/or said plug having means for preventing their mutual rotation and detachment.

16. An automatic lock slider for a concealed slide fastener according to claim 1, wherein said knob is an ornament fixed to said pivoting release member so as to cover exposed part of said slider body.

17. An automatic lock slider for a concealed slide fastener according to claim 16, wherein said knob has a socket tube projecting from its lower surface, and said pivoting release member has a plug to be inserted in said socket tube, said socket tube and/or said plug having means for preventing their mutual rotation and detachment.

18. An automatic lock slider for a concealed slide fastener according to claim 1, wherein said knob has a socket tube projecting from its lower surface, and said pivoting release member has a plug to be inserted in said socket tube, said socket tube and/or said plug having means for preventing their mutual rotation and detachment.

* * * * *